US007841398B2

(12) United States Patent
Tibbles et al.

(10) Patent No.: US 7,841,398 B2
(45) Date of Patent: Nov. 30, 2010

(54) GRAVEL PACKING APPARATUS UTILIZING DIVERTER VALVES

(75) Inventors: Raymond J. Tibbles, Kuala Lumpur (MY); Tomaso U. Ceccarelli, Kuala Lumpur (MY); Bryan Stamm, Houston, TX (US); Mehmet Parlar, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/020,328

(22) Filed: Jan. 25, 2008

(65) Prior Publication Data

US 2009/0133875 A1 May 28, 2009

Related U.S. Application Data

(60) Provisional application No. 60/990,038, filed on Nov. 26, 2007.

(51) Int. Cl.
*E03B 3/18* (2006.01)

(52) U.S. Cl. ..... 166/227; 166/278

(58) Field of Classification Search ..... 166/227, 166/278

See application file for complete search history.

(56) References Cited

U.S. PATENT DOCUMENTS 6,516,881 B2 2/2003 Hailey, Jr.
6,575,243 B2 6/2003 Pabst
6,808,020 B2 10/2004 Garcia et al.
6,883,608 B2 * 4/2005 Parlar et al. ..... 166/278
7,100,691 B2 * 9/2006 Nguyen et al. ..... 166/278
7,152,677 B2 12/2006 Parlar et al.
7,204,307 B2 4/2007 Roddy et al.
7,261,160 B2 8/2007 Welton et al.
7,296,624 B2 11/2007 Rodet et al.
2005/0028978 A1 * 2/2005 Parlar et al. ..... 166/278
2006/0283791 A1 12/2006 Ross
2007/0227731 A1 * 10/2007 Contant ..... 166/278

* cited by examiner

*Primary Examiner*—Jennifer H Gay
*Assistant Examiner*—Yong-Suk Ro
(74) *Attorney, Agent, or Firm*—David G. Matthews; Rodney V. Warfford; Edmonds Nolte PC

(57) ABSTRACT

Method and apparatus for gravel packing an open-hole wellbore are disclosed. The apparatus includes a sandscreen disposed in the wellbore thereby creating an annulus between the wellbore and the sandscreen for receiving a gravel slurry. The apparatus further comprises a tubular member or wash pipe which is concentrically disposed in the sandscreen for receiving carrier fluid which passes through the sandscreen and for returning the carrier fluid to the earth's surface. At least one diverter valve is installed in the tubular member for permitting flow of the carrier fluid into the tubular member.

20 Claims, 2 Drawing Sheets

GRAVEL PACKING APPARATUS UTILIZING DIVERTER VALVES

CROSS-REFERENCE TO RELATED APPLICATION

The present application claims the benefit of the filing date of U.S. Provisional Patent Application No. 60/990,038, filed Nov. 26, 2007.

BACKGROUND OF THE INVENTION

1. Field of the Invention

The invention generally relates to gravel packing a well.

2. Description of the Prior Art

When well fluid is produced from a subterranean formation, the fluid typically contains particulates, or "sand." The production of sand from the well must be controlled in order to extend the life of the well, and one technique to accomplish this involves routing the well fluid through a downhole filter formed from gravel that surrounds a sandscreen. More specifically, the sandscreen typically is a cylindrical mesh that is inserted into and is generally concentric with the borehole of the well where well fluid is produced. Gravel is packed between the annular area between the formation and the sandscreen, called the "annulus." The well fluid being produced passes through the gravel, enters the sandscreen and is communicated uphole via tubing called a "wash pipe" that is inside of and concentric with the sandscreen.

The gravel that surrounds the sandscreen typically is introduced into the well via a gravel packing operation. In a conventional gravel packing operation, the gravel is communicated downhole via a slurry, which is a mixture of a carrier fluid and gravel. A gravel packing system in the well directs the slurry around the sandscreen so that when the fluid in the slurry disperses, gravel remains around the sandscreen.

A potential shortcoming of a conventional gravel packing operation is the possibly that carrier fluid may prematurely leave the slurry, either through the sandscreen or into the formation or both. When this occurs, a gravel plug commonly called a "bridge" forms in the slurry flow path, and this bridge forms a barrier that prevents slurry that is upstream of the bridge from being communicated downhole past the bridge. Thus, the bridge disrupts and possibly prevents the application of gravel around some parts of the sandscreen.

One type of gravel packing operation involves the use of a slurry that contains a high viscosity carrier fluid. Due to the high viscosity of this carrier fluid, the slurry may be communicated downhole at a relatively low velocity without significant fluid loss. However, the high viscosity fluid typically is expensive and may present environmental challenges relating to its use. Another type of gravel packing operation involves the use of a low viscosity fluid, such as a fluid primarily formed from water, in the slurry. The low viscosity fluid typically is less expensive than the high viscosity fluid. This results in a better quality gravel pack (leaves less voids in the gravel pack than high viscosity fluid) and may be less harmful to the environment. However, a potential challenge in using the low viscosity fluid is that the velocity of the slurry must be higher than the velocity of the high viscosity fluid-based slurry in order to prevent fluid from prematurely leaving the slurry.

A two-phase gravel packing operation has been used to distribute gravel around a sandscreen. The first phase involves gravel packing the well from the bottom up by introducing a gravel slurry flow into the annulus, as described above. If one or more bridges form during the first phase of the gravel packing operation, the gravel packing operation enters a second phase to circumvent these bridges in which the slurry flow is routed through alternative slurry flow paths commonly called "shunt tubes." Such shunt tubes are, for example, disclosed in U.S. Pat. No. 7,147,054.

Even when using shunt tubes, the process of gravel packing is complicated by many factors including the friction pressure in long wash pipe sections (both wash-pipe/base-pipe annulus and wash-pipe itself) and the presence of potentially damaging formations such as shale formations. The friction pressure formation in the wash pipe sections can cause bottom hole pressure to exceed the fracturing pressure of the formation. Such a condition has negative side effects including: (1) potential loss of hydrostatic pressure creating a situation in which well control can be lost; (2) loss of expensive fluids to the formation either during or after the gravel packing process; and (3) loss of potentially damaging fluids to the formation either during or after the gravel pack operation. The presence of formations like reactive shale in the open hole can cause the fluid and gravel mixture to become contaminated with the shale and lead to damaged screens (plugged) and/or a damaged gravel pack.

SUMMARY OF THE INVENTION

In accordance with the present invention, gravel packing apparatus is provided for gravel packing an open-hole wellbore which comprises a sandscreen which is disposed in the wellbore, thereby creating an annulus between the wellbore and the sandscreen for receiving a gravel slurry. The apparatus further comprises a tubular member or wash pipe having at least one diverter valve or port therein to prevent fluid losses in the wash pipe due to friction, and the tubular member is concentrically disposed in the sandscreen. The at least one diverter valve functions to permit carrier fluid to enter the wash pipe at a location or locations other than the end of the wash pipe. The diverter valve may be utilized with gravel packing apparatus which comprises shunt tubes and with gravel packing apparatus that does not utilize shunt tubes.

Additionally, if reactive shale is present in the downhole formation, a diverter valve may be placed in the wash pipe proximate the shale to intentionally create a bridge in that portion of the annulus between the wellbore and the sandscreen proximate the shale. By controlling the velocity of the slurry, the section of the annulus between the wellbore and the sandscreen proximate the shale thus packs first. The sandscreen thus is not contaminated with the shale.

A further embodiment of the present invention comprises a swellable packer which is used in conjunction with shunt tubes. In this embodiment, a diverter valve may be placed in the wash pipe proximate the swellable packer to intentionally gravel pack that portion of the annulus between the wellbore and the sandscreen upstream and downstream of the swellable packer. The portion of the annulus around the swellable packer is not, however, gravel packed. The swellable packer is therefore allowed to swell at a later time after the gravel packing operation has been terminated, and to contact the formation face directly which provides competent isolation of the open hole above and below the swellable packer.

DETAILED DESCRIPTION OF THE INVENTION

It will be appreciated that the present invention may take many forms and embodiments. In the following description, some embodiments of the invention are described and numerous details are set forth to provide an understanding of the present invention. Those skilled in the art will appreciate, however, that the present invention may be practiced without those details and that numerous variations and modifications from the described embodiments may be possible. The following description is thus intended to illustrate and not to limit the present invention.

Figure 1:
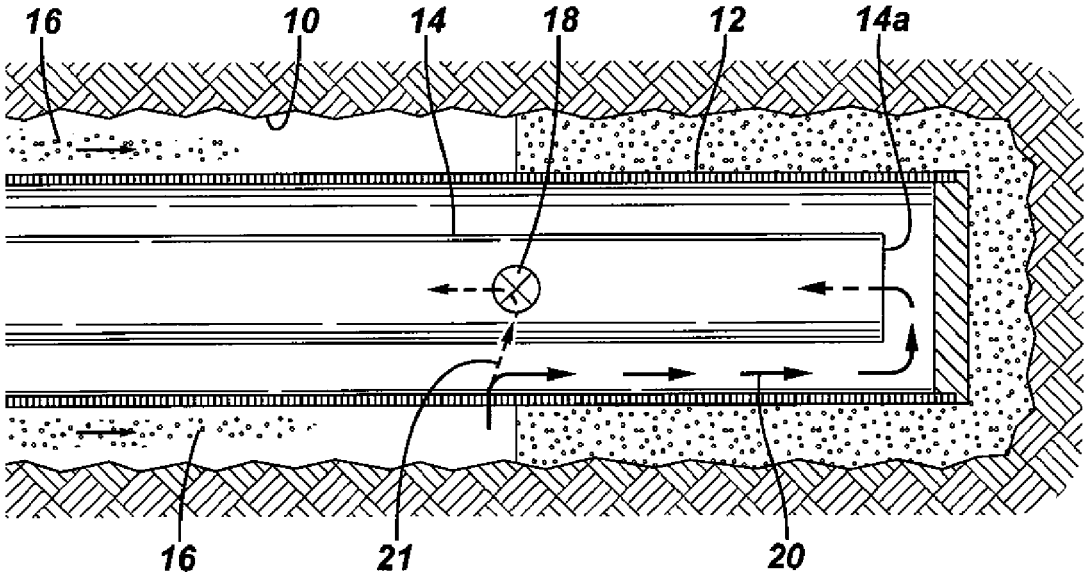
FIG. 1 is an elevation view in partial cross-section of a wellbore containing one embodiment of gravel packing apparatus in accordance with the present invention.

With reference first to FIG. 1, open-hole gravel packing apparatus is illustrated deployed in wellbore 10. This open-hole gravel packing apparatus comprises a sandscreen 12 which is disposed in the wellbore 10, and a tubular member or wash pipe 14 which is concentrically disposed within sandscreen 12. Gravel slurry 16 is pumped into the annulus between wellbore 10 and sandscreen 12 and a portion of the carrier fluid in the gravel slurry passes through sandscreen 12 and is returned to the surface via wash pipe 14. The gravel disposed in the annulus between wellbore 10 and sandscreen 12 thus remains in place.

The flow path for carrier fluid to be returned to the surface in prior art systems is in the annulus between the wash pipe 14 and the sandscreen 12. The carrier fluid travels to the end of 14a of wash pipe 14 via flow path 20 and then is returned to the surface. As noted above, friction pressure in long wash pipe sections can cause bottom hole pressure to exceed the fracturing pressure of the formation and has negative side effects. In order to reduce this friction pressure, apparatus in accordance with the present invention comprises at least one diverter valve 18 which is installed in the wash pipe 14 to prevent fluid losses due to friction. In one embodiment, a plurality of diverter valves 18 may be installed in the wash pipe 14. Carrier fluid entering the annulus between sandscreen 12 and wash pipe 14 proximate diverter valve 18 flows through diverter valve 18 and into wash pipe 14 via flow path 21.

Figure 2:
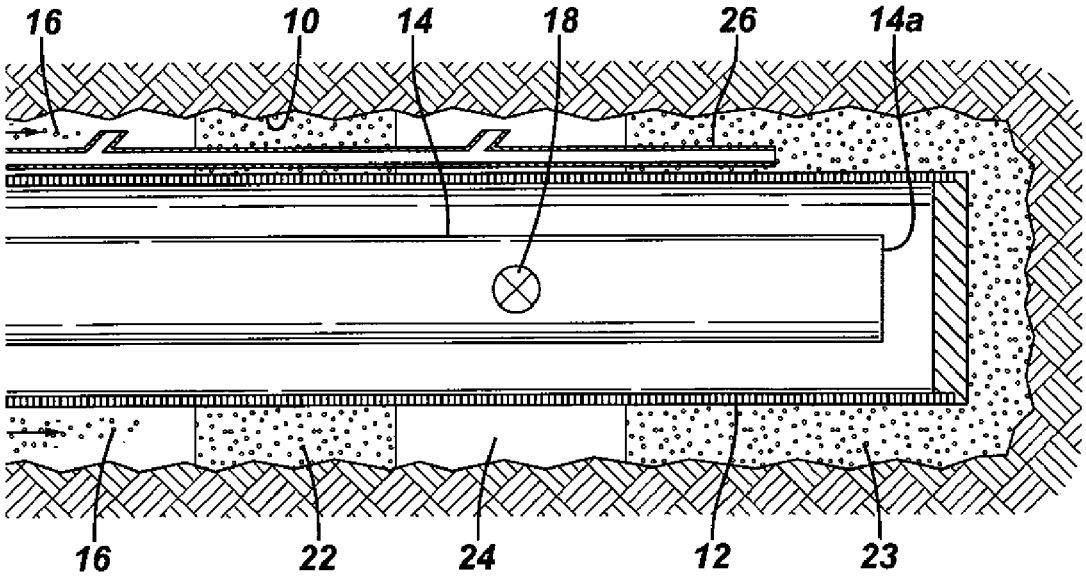
FIG. 2 is an elevation view in partial cross-section of another embodiment of gravel apparatus in accordance with the present invention which also utilizes shunt tubes.

With reference to FIG. 2, there is illustrated an embodiment of open-hole gravel packing apparatus in accordance with the present invention which utilizes shunt tube apparatus 26. While only one shunt tube is illustrated in FIG. 2 those skilled in the art will appreciate that shunt tube apparatus 26 may comprise a plurality of shunt tubes disposed circumferentially around sandscreen 14. In the course of gravel packing wellbore 10, a bridge 22 may form due to the loss of carrier fluid in that region. In such case, a void area 24 is formed between bridge 22 and previously gravel packed region 23. In order to fill the void area 24 with gravel, the gravel slurry is pumped down the shunt tube apparatus 26. In this embodiment, apparatus according to the present invention comprises at least one diverter valve 18 which is installed in the wash pipe 14 proximate the void are 24. Diverter valve 18 permits the carrier fluid from the slurry injected into the void area 24 to be returned to the surface without having to travel to end 14*a* of wash pipe 14 to be returned The formation of adverse friction pressure is thus avoided in this embodiment.

Figure 3:
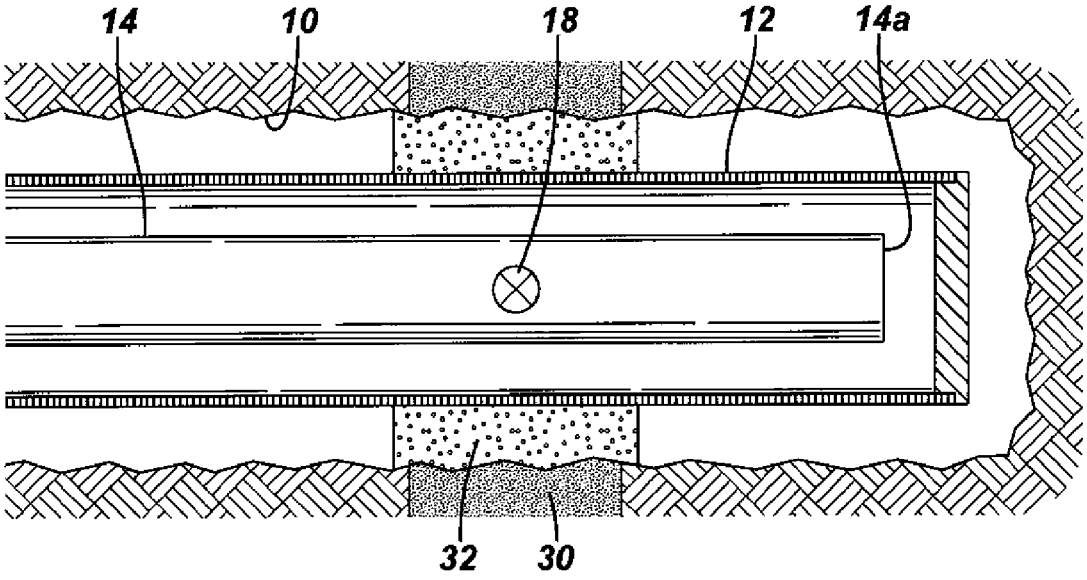
FIG. 3 is an elevation view in partial cross-section of a wellbore in which a bridge is intentionally created to prevent a reactive shale portion from contaminating of the gravel slurry.

Referring now to FIG. 3, in situations where reactive shale 30 is present in the downhole formation, it may be desirable to intentionally create a bridge 32 across the reactive shale region 30. In such an instance, a diverter valve 18 may be installed in wash pipe 14 proximate the reactive shale region 30 to insure that the section of the annulus abutting the reactive shale region 30 packs first and that the gravel slurry is not contaminated with the shale. The remainder of the annulus between the wellbore 10 and the sandscreen 12 may be gravel packed utilizing shunt tube apparatus as described above.

Diverter valve 18 may, for example, comprise any valve which will permit one-way flow of the carrier fluid into the wash pipe 14 from the annulus between the sandscreen 12 and wash pipe 14, but will prevent flow of carrier fluid in the opposite direction. Also, a desirable characteristic of diverter valve 18 would be that it be pressure-actuated. Those skilled in the art, having the benefit of this disclosure, will understand how to implement diverter valve 18. Specific examples of diverter valve 18 include check valves and relief valves.

The operation of the diverter valve 18 in each embodiment of the present invention may be remotely controlled from the earth's surface. In one embodiment, wash pipe 14 comprises wired pipe with the diverter valve 18 being operatively connected to the wire in the wired pipe. The portion of the wire above the earth's surface may be connected to a remote control device. In another embodiment, a wireless telemetry apparatus remotely controls the operation of each diverter valve at the earth's surface.

Figure 4:
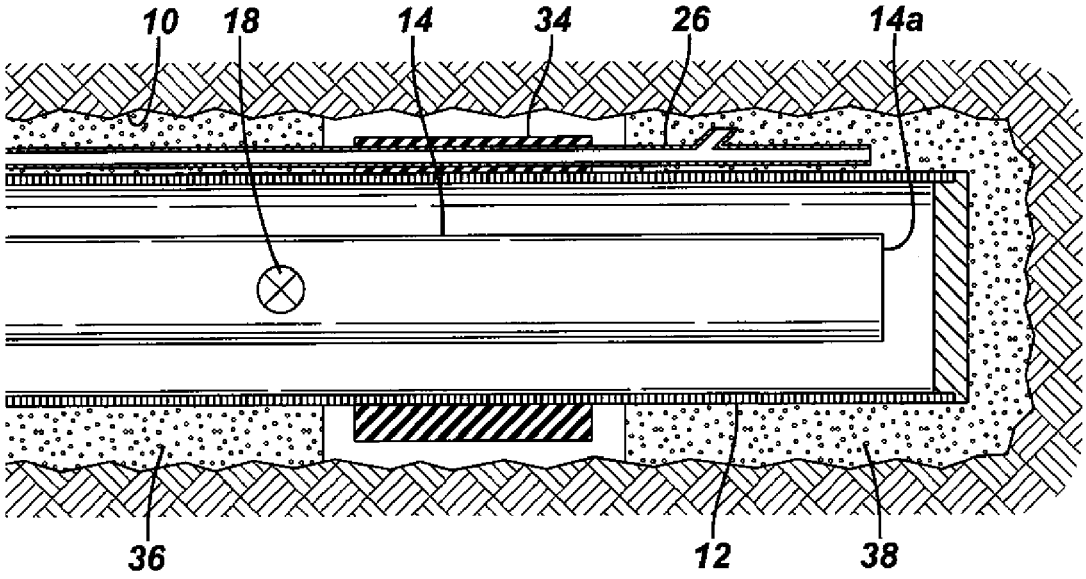
FIG. 4 is an elevation view in partial cross-section of a wellbore illustrating the use of a diverter valve illustrating the use of a diverter valve in a wash pipe to gravel pack on either side of a swellable packer.

With reference to FIG. 4, when gravel packing a gravelscreen 12 inside the wellbore 10, which can be an "open hole" wellbore as depicted, a diverter valve 18 forces fluid to bypass the washpipe entrance 14a and create a bridge and gravel pack in area 36. After area 36 has been gravel packed, the slurry flow is directed through shunt tubes 26 and gravel packs area 38, hence leaving swellable packer 34 with no gravel around it. This allows the swellable packer 34 to swell and make direct contact with the wellbore 10 at a time after the gravel packing operation has terminated.

In accordance with the present invention, a method of gravel packing a wellbore is provided which comprises the steps of drilling a reservoir with a synthetic/oil-based drilling mud and running a predrilled liner in the synthetic/oil-based drilling mud. A method of gravel packing according to the present invention further comprises the steps of displacing the mud in the wellbore with water-based fluids and running a sandscreen into the wellbore containing at least one diverter valve. The method further comprises the step of introducing a gravel slurry comprising a water-based fluid into the annulus between the sandscreen and the wellbore. The water-based fluid may be a brine, a viscoelastic surfactant or a polymer solution.

In accordance with the present invention, yet another method of gravel packing a wellbore is provided which comprises the steps of drilling a reservoir with a synthetic/oil-based drilling mud and conditioning the drilling mud by passing it through shaker screens. This method of gravel packing further comprises the steps of running a sandscreen containing one or more diverter valves into the wellbore and then introducing a gravel slurry into the annulus between the sandscreen and the wellbore. The gravel slurry may comprise either an oil-based carrier fluid, e.g., an oil-external brine internal emulsion, or a water-based carrier fluid, e.g., a brine, viscoelastic surfactant solution or a polymer solution.

In one embodiment, the shaker screens have openings smaller than or equal to ¼ of the sandscreen openings.

What is claimed is:

1. A method for forming a gravel plug in a wellbore comprising:

pumping a gravel slurry into a wellbore annulus about a tubular member disposed therein, wherein the tubular member comprises at least one diverter valve in fluid communication with an inside diameter of the tubular member and the wellbore annulus; and directing at least a portion of the gravel slurry through the diverter valve into the inside diameter of the tubular member to form a gravel plug within the wellbore annulus.

2. The method of claim 1, wherein the tubular member comprises a plurality of diverter valves.

3. The method of claim 2, further comprising remotely controlling the operation of the diverter valves.

4. The method of claim 3, wherein the diverter valves are remotely controlled using a wireless telemetry apparatus.

5. The method of claim 1, wherein the gravel plug is formed adjacent a potentially damaging region of the wellbore.

6. The method of claim 5, wherein the potentially damaging region of the wellbore comprises shale.

7. The method of claim 1, wherein the gravel plug is formed adjacent a swellable packer disposed about the tubular member.

8. A method for gravel packing a wellbore, comprising:

pumping a gravel slurry into a portion of a wellbore annulus about a tubular member disposed therein, wherein the tubular member comprises at least one diverter valve in fluid communication with an inside diameter of the tubular member and the wellbore annulus;

directing at least a portion of the gravel slurry through the diverter valve into the inside diameter of the tubular member to form a gravel plug within a portion of the wellbore annulus adjacent a swellable packer, wherein the swellable packer is disposed about the tubular member; and diverting the gravel slurry around the swellable packer and gravel packing another portion of the wellbore annulus.

9. The method of claim 8, wherein the wellbore is an open hole wellbore.

10. The method of claim 8, wherein the tubular member comprises a plurality of diverter valves.

11. The method of claim 10, further comprising remotely controlling the operation of the diverter valves.

12. The method of claim 11, wherein the diverter valves are remotely controlled using a wireless telemetry apparatus.

13. The method of claim 8, further comprising expanding the swellable packer, wherein the wellbore annulus surrounding the swellable packer is free of gravel.

14. The method of claim 13, wherein the swellable packer directly contacts at least a portion of a wall of the wellbore when the swellable packer is expanded.

15. A method for gravel packing a wellbore, comprising:

pumping a gravel slurry into a portion of a wellbore annulus about a tubular member disposed therein, wherein the tubular member comprises at least one diverter valve in fluid communication with an inside diameter of the tubular member and the wellbore annulus;

directing at least a portion of the gravel slurry through the diverter valve into the inside diameter of the tubular member to form a gravel plug within a portion of the wellbore annulus adjacent a swellable packer;

diverting the gravel slurry around the swellable packer and gravel packing another portion of the wellbore annulus; and expanding the swellable packer, wherein the wellbore annulus surrounding the swellable packer is free of gravel.

16. The method of claim 15, wherein the wellbore is an open hole wellbore.

17. The method of claim 15, wherein the tubular member comprises a plurality of diverter valves.

18. The method of claim 17, further comprising remotely controlling the operation of the diverter valves.

19. The method of claim 18, wherein the diverter valves are remotely controlled using a wireless telemetry apparatus.

20. The method of claim 15, wherein the swellable packer directly contacts at least a portion of a wall of the wellbore when the swellable packer is expanded.

* * * * *